US008011130B2

(12) United States Patent
Chang et al.

(10) Patent No.: US 8,011,130 B2
(45) Date of Patent: Sep. 6, 2011

(54) GUN SIGHT MOUNTING DEVICE

(75) Inventors: Eric E. Chang, Dallas, TX (US); Terrance L. Eck, Plano, TX (US); Richard L. Scott, The Colony, TX (US)

(73) Assignee: Raytheon Company, Waltham, MA (US)

( * ) Notice: Subject to any disclaimer, the term of this patent is extended or adjusted under 35 U.S.C. 154(b) by 683 days.

(21) Appl. No.: 11/774,210

(22) Filed: Jul. 6, 2007

(65) Prior Publication Data

US 2010/0275494 A1 Nov. 4, 2010

(51) Int. Cl.
*F41G 1/387* (2006.01)

(52) U.S. Cl. ..... 42/124; 89/41.17

(58) Field of Classification Search ..... 42/124, 42/127; 89/41.17, 42.01
See application file for complete search history.

(56) References Cited

U.S. PATENT DOCUMENTS

| | | | | |
|---|---|---|---|---|
| 2,597,466 | A * | 5/1952 | Felix | 42/127 |
| 2,783,539 | A * | 3/1957 | Dahlberg | 42/126 |
| 3,177,587 | A * | 4/1965 | Hart | 42/126 |
| 3,483,623 | A * | 12/1969 | Kruzell | 42/127 |
| 3,579,840 | A * | 5/1971 | Heinzel | 42/127 |
| 3,659,494 | A * | 5/1972 | Philbrick et al. | 89/28.05 |
| 4,026,054 | A * | 5/1977 | Snyder | 42/115 |
| 4,027,414 | A | 6/1977 | Felix | |
| 4,505,182 | A * | 3/1985 | Sullivan | 89/132 |
| 4,934,085 | A * | 6/1990 | Lough | 42/127 |
| 5,068,968 | A * | 12/1991 | Sillery | 89/200 |
| 5,189,245 | A * | 2/1993 | Bundy | 89/14.1 |
| 5,425,191 | A | 6/1995 | Taylor et al. | |
| 5,531,039 | A | 7/1996 | Gore | |
| 5,669,174 | A * | 9/1997 | Teetzel | 42/115 |
| 5,974,940 | A * | 11/1999 | Madni et al. | 89/41.17 |
| 6,237,463 | B1 * | 5/2001 | Grizzaffi | 89/41.17 |
| 6,378,237 | B1 * | 4/2002 | Matthews et al. | 42/124 |
| 6,678,988 | B1 * | 1/2004 | Poff, Jr. | 42/147 |
| 7,350,452 | B2 * | 4/2008 | Plumier et al. | 89/37.03 |
| 2004/0016169 | A1 * | 1/2004 | Poff, Jr. | 42/124 |
| 2007/0074443 | A1 | 4/2007 | La France | |

FOREIGN PATENT DOCUMENTS

| | | |
|---|---|---|
| BE | 1 014 676 | 3/2004 |
| FR | 2 544 063 | 10/1984 |
| FR | 2 588 370 | 4/1987 |
| FR | 2 611 036 | 8/1988 |

OTHER PUBLICATIONS

Notification of Transmittal of the International Search Report and the Written Opinion of the ISA, or the Declaration for PCT US2008/066821, ISA/EP (32 pages), Jul. 6, 2009.

* cited by examiner

*Primary Examiner* — Bret Hayes
(74) *Attorney, Agent, or Firm* — Baker Botts L.L.P.

(57) ABSTRACT

An apparatus generally includes a gun mount portion and a sight mount portion that are coupled together by a resilient member. The gun mount portion provides attachment to a gun and the sight mount portion provides attachment to a gun sight. The resilient member is configured to allow, when attached to the gun, a linear displacement of the sight mount portion relative to the gun mount portion along a longitudinal axis of the gun.

23 Claims, 4 Drawing Sheets

GUN SIGHT MOUNTING DEVICE

TECHNICAL FIELD OF THE DISCLOSURE

This disclosure relates generally to gun sights, and more particularly, to a gun sight mounting device for attachment of a gun sight to a gun.

BACKGROUND OF THE DISCLOSURE

Gun sights are typically configured on a gun for the purpose of enhancing its aim. Traditionally, iron sights have been used to enable aiming of the gun toward its intended target. Advances in optical and electronics technology, however, have led to the development of more sophisticated gun sights that enable enhanced visibility and/or magnification than traditional iron sights. One particular type of gun sight that may provide enhanced visibility is a night vision gun sight. The night vision gun sight generally includes an infrared camera that is operable to create an image from the infrared portion of the electro-magnetic spectrum for view by a user. This type of gun sight has enabled enhanced capability in that aiming of the gun may be accomplished in generally low light conditions.

SUMMARY OF THE DISCLOSURE

An apparatus generally includes a gun mount portion and a sight mount portion that are coupled together by a resilient member. The gun mount portion provides attachment to a gun and the sight mount portion provides attachment to a gun sight. The resilient member is configured to allow, when attached to the gun, a linear displacement of the sight mount portion relative to the gun mount portion along a longitudinal axis of the gun.

Some embodiments of the disclosure may provide numerous technical advantages. Some embodiments may benefit from some, none, or all of these advantages. For example, according to one embodiment, the shock response spectrum experienced by the gun sight during the recoil action of the gun may be tailored to alleviate vibrational energy at certain frequencies. These frequencies may be natural resonant frequencies of certain components of the gun sight that may be damaged as a result of excess vibrational energy being transferred from the gun to the gun sight. These gun sights may therefore, be coupled to guns that were heretofore precluded from use due to excessive shock or vibrational energy being imparted onto the gun sight during operation of the gun.

Other technical advantages may be readily ascertained by one of ordinary skill in the art.

BRIEF DESCRIPTION OF THE DRAWINGS

A more complete understanding of embodiments of the disclosure will be apparent from the detailed description taken in conjunction with the accompanying drawings in which.

DETAILED DESCRIPTION OF EXAMPLE EMBODIMENTS OF THE DISCLOSURE

Advances in optical and electronics technology have enabled the development of gun sights having enhanced characteristics over traditional iron sights. To enable this enhanced capability, these gun sights may incorporate various optical or electronic components that may be generally intricate and/or delicate in nature. Gun sights having delicate components, however, may be precluded from use on certain guns that generate significant mechanical stresses, such as shock vibration introduced by recoil of the gun.

Figure 1:
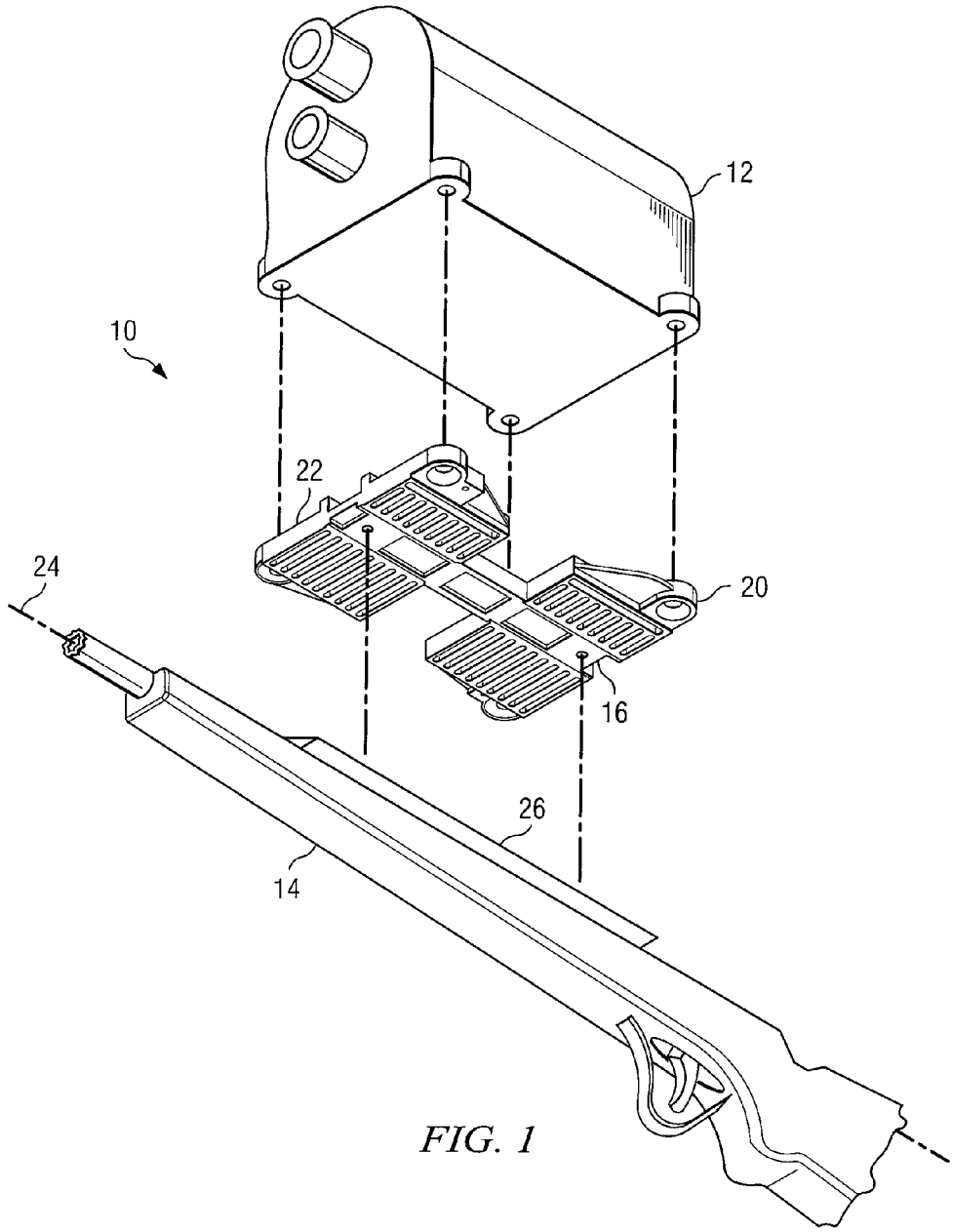
FIG. 1 is a perspective view of one embodiment of a gun sight, a gun, and a gun sight mounting device that may be coupled between the gun sight and the gun.

FIG. 1 shows one embodiment of a gun sight mounting device 10 according to the teachings of the present disclosure that may be used to attach a gun sight 12 to a gun 14 in which gun sight mount mounting device 10 is disassembled from the gun 14 to reveal its various features. Gun sight mounting device 10 generally includes a gun mount portion 16 and a sight mount portion 20 that are coupled together through a resilient member 22. Gun 14 has a longitudinal axis 24 that extends along its barrel 24. As will be described in detail below, the resilient member 22 may be operable to allow a linear displacement of the sight mount portion 20 relative to the gun mount portion 16 along a longitudinal axis 24 of the gun 14 for reducing mechanical stresses that may be placed upon the gun sight 12 by a recoil action of the gun 14 during use.

The gun 14 may be any suitable type that may be used in conjunction with gun sight 12. In one particular embodiment, gun 14 may be a military rifle, such as an M4 rifle. The gun sight mounting device 10 may be coupled to gun 14 by gun mount portion 16. Gun mount portion 16 may be any suitable coupling device. In one embodiment, the gun mount portion 16 may be a picatinny coupling that is compliant to military standard specification (MIL-STD-1913) and operable to be configured on gun 14 having a picatinny rail 26.

The gun sight 12 may be any suitable gun sight 12 and may be, for example, a telescopic gun sight, a night vision camera, or any other device that may enhance the visibility and/or aiming capability of a target for a user of the gun 14. The gun sight 12 may, or may not, have one or more intricate or delicate components that may be potentially damaged by vibrational forces generated by the gun 14. For example, a particular gun sight 12 that is operable to generate images in low-light conditions, such as a night vision camera, may have electronic or optical components that are susceptible to damage from these vibrational forces. Certain embodiments of the present disclosure may provide an advantage in that the gun sight mounting device 10 may enable use of various types of gun sights 12 that have been heretofore been precluded from use due to excessive vibrational forces placed upon the gun sight 12 during operation of the gun 14. The gun sight mounting device 10 may also enhance the durability of gun sights 12 in certain embodiments.

Figure 2A:
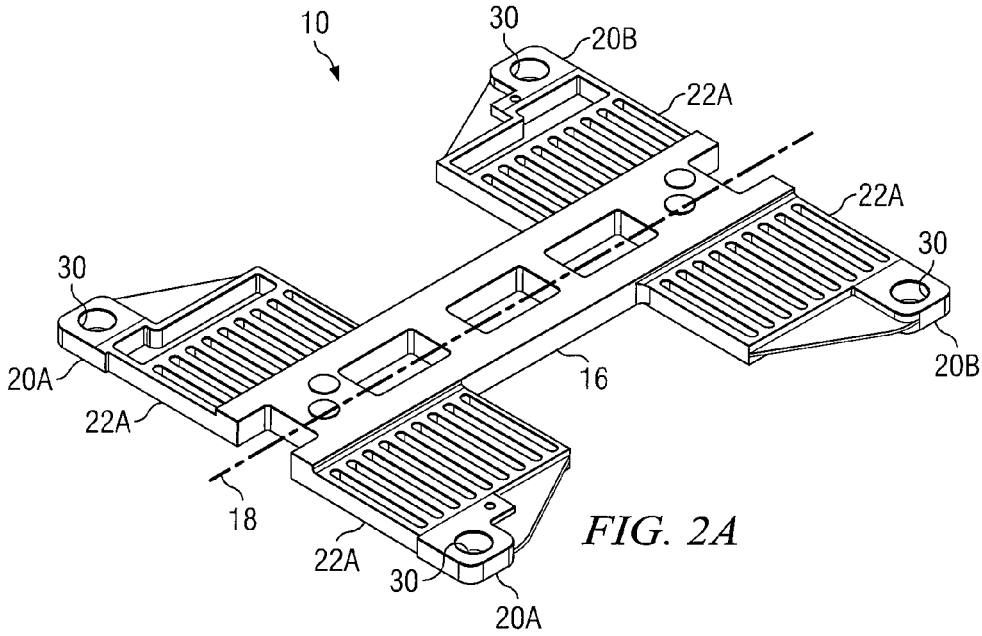
FIG. 2A is a perspective view of the gun sight mounting device of FIG. 1 that has been removed from the gun sight and gun.
Figure 2B:
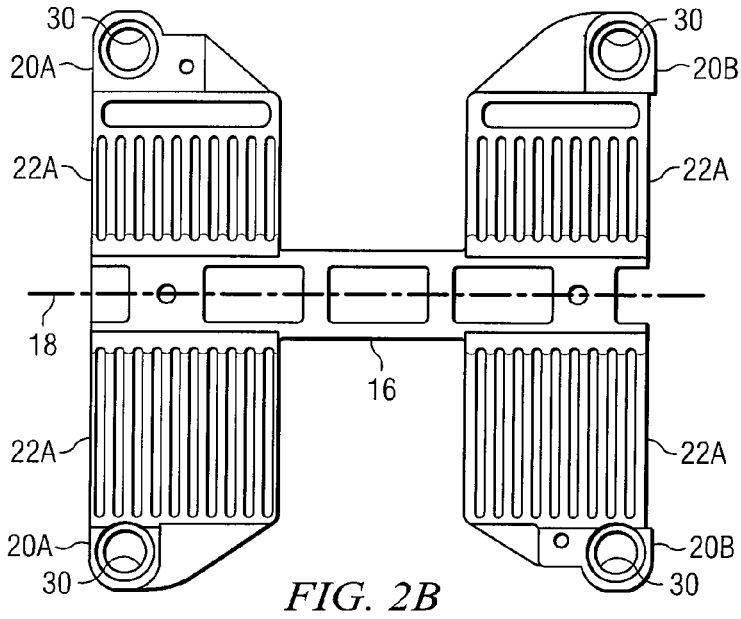
FIG. 2B is a top view of the embodiment of FIG. 2A.
Figure 2C:
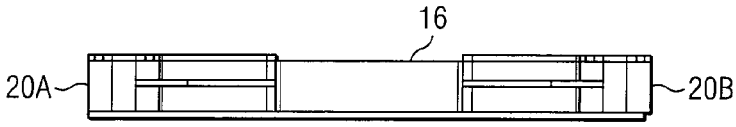
FIG. 2C is a side elevational view of the embodiment of FIG. 2A.

FIGS. 2A, 2B, and 2C show a perspective view, a top view, and an elevational view, respectively of the gun sight mounting device 10 of FIG. 1 that has been removed from the gun sight 12. In this particular embodiment, resilient member 22 is a plurality of leaf springs 22*a* that extend from the gun mount portion 16 to the sight mount portion 20. The leaf springs 22*a* are generally flexible along a direction that is parallel to a sight mount portion axis 18. When coupled to the gun 14, the sight mount portion axis 18 may be generally parallel to the longitudinal axis 24 of the gun 14. In one embodiment, the resilient member 22 may be generally inflexible along other axes of the sight mount portion 16 that are not parallel to the longitudinal axis 24 when the gun sight mounting device 10 is coupled to the gun 14. In this manner, the gun sight 12 may flex along the longitudinal axis 24 due to recoil of the gun 14 while maintaining relatively good alignment or boresight with the gun's barrel 24. The leaf springs 22*a* may be sufficiently resilient to transfer vibration energy from potentially harmful vibrational frequencies to one or more lower natural frequencies that may not be as harmful to the gun sight 12.

In this particular embodiment, resilient member 22 is a plurality of leaf springs 22*a*; however, resilient member 22 may be any generally resilient device that allows a linear displacement of the sight mount portion 20 relative to the gun mount portion 16 along the longitudinal axis 24 of the gun 14. In one embodiment, resilient member 22 may be any suitable device that is generally inflexible along other axes that are not parallel to the longitudinal axis 24 of the gun 14.

In one embodiment, the leaf springs 22*a* may have a cumulative spring constant such that the resonant frequency of the sight mount portion 20 and gun sight 12 are different from the resonant frequency of a particular component of the gun sight 12. For example, gun sight 12 may have an image sensing device with a particular natural resonant frequency. Excitation of the gun sight 12 with vibrational energy approximately at its natural resonant frequency may cause the sensing device to be damaged or result in reduced durability. By designing the leaf springs 22*a* to have a particular spring constant such that the resonant frequency of the sight mount portion 20 and gun sight 12 are different, vibrational energy at the natural resonant frequency of image sensing device may be effectively reduced.

Sight mount portion 20 may be any suitable mechanism for coupling the gun sight mounting device 10 to the gun sight 12. In the particular embodiment shown in FIGS. 2A, 2B, and 2C, sight mount portion 20 includes two front sight attachment members 20*a* and two rear sight attachment members 20*b* arranged in a rectilinear spaced apart relation to one another. Each of these sight attachment members 20*a* and 20*b* has a hole 30 such that a hole pattern is formed that corresponds to the hole pattern of the gun sight 12. Although the sight mount portion 20 is described having four sight attachment members 20*a* and 20*b* configured in a rectilinear spaced apart relation, it should be appreciated that sight mount portion 20 may have any configuration, such as hole pattern geometry, hole quantity, or other attachment mechanism that may be releasably secured the gun sight 12. In one embodiment, each of the leaf springs 22*a* are attached to the sight mount portion 20 proximate one of the sight attachment members 20*a* or 20*b*.

The material from which the gun sight mounting device 10 is made may be any suitable material that will maintain its structural characteristics and allow the resilient member 22 to have an a spring constant that remains within acceptable levels during normal use. In one embodiment, the sight mount portion 20, resilient member 22, and gun mount portion 16 are integrally formed together from one piece of material, such as aluminum.

Figure 3A:
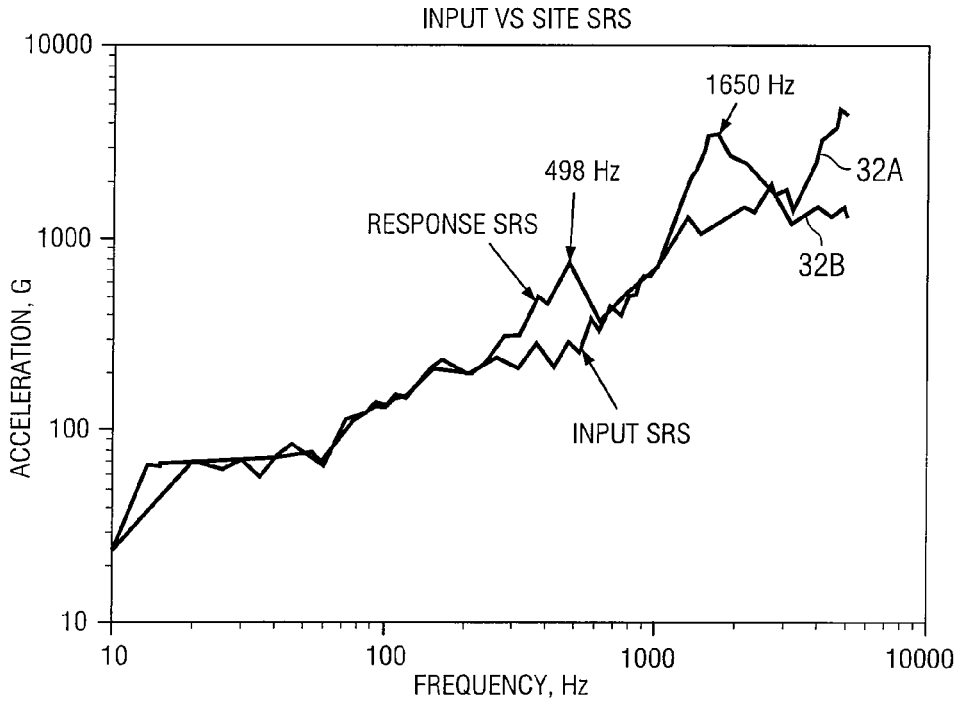
FIG. 3A is a graph showing excitation and response shock spectrums for a test administered upon an example of the gun sight that was mounted to the gun without the embodiment of FIG. 1.

FIG. 3A is a graph showing a shock response spectrum (SRS) of a test that was performed on a gun sight 12 that was mounted to a gun 14 with a known mounting device having no resilient member to reduce vibrational energy to the gun sight 12. Plot 32*a* is the shock response spectrum (SRS) of the input or excitation vibrational energy that may be caused by recoil of the gun 14. Plot 32*b* is the shock response spectrum of the response vibrational energy exerted upon the gun sight 12. As can be seen, plot 32*b* has several relative maximum excitation values at 498 Hertz and 1650 Hertz. For certain gun sights 12, vibrational energy at these frequencies and levels may be damaging to various components in the gun sight 12.

Figure 3B:
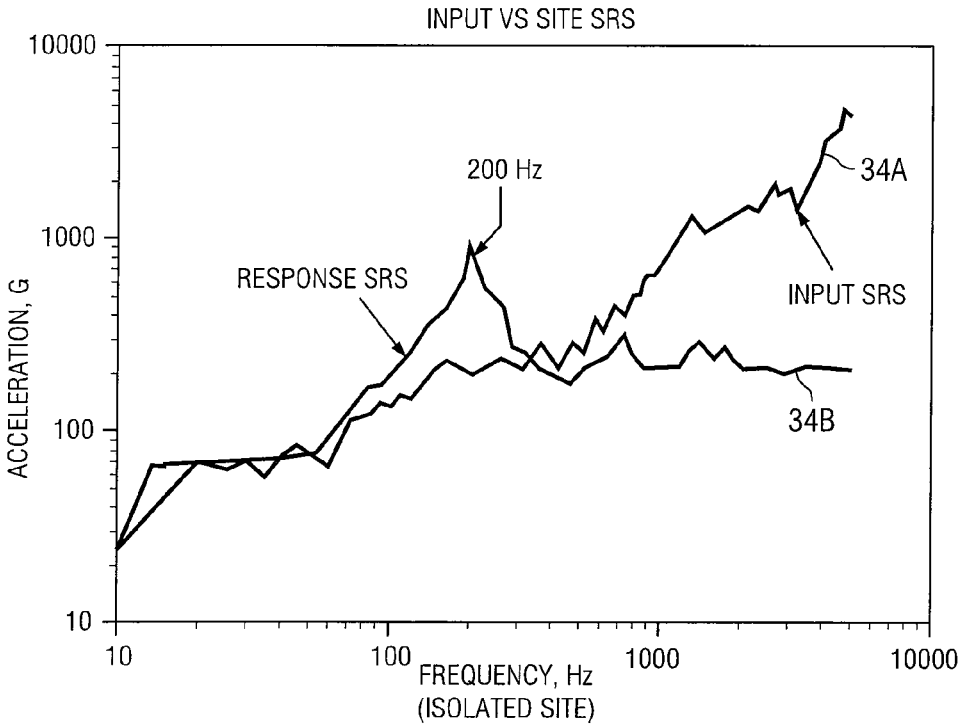
FIG. 3B is a graph showing excitation and response shock spectrums for a test administered upon an example of the gun sight that was mounted to the gun with the embodiment of FIG. 1.

FIG. 3B is another graph showing a shock response spectrum (SRS) of a test that was performed on a gun sight 12 that was mounted to a gun 14 using the gun sight mounting device 10. Plot 34*a* is the shock response spectrum (SRS) of the input or excitation vibrational energy that may be caused by recoil of the gun 14. Plot 34*b* is the shock response spectrum of the response vibrational energy exerted upon the gun sight 12. As can be seen, a relative maximum value exists at approximately 200 Hertz, but at a significantly lower level than exhibited by the gun sight 12 without the aid of the gun sight mounting device 10. Moreover, vibrational energy at 498 Hertz and 1650 Hertz, which may be damaging to various components within the gun sight 12, has been reduced. As can be seen, vibrational energy at these frequencies may be reduced by transferring the natural frequencies to a lower natural frequency of approximately 200 Hertz.

Figure 4:
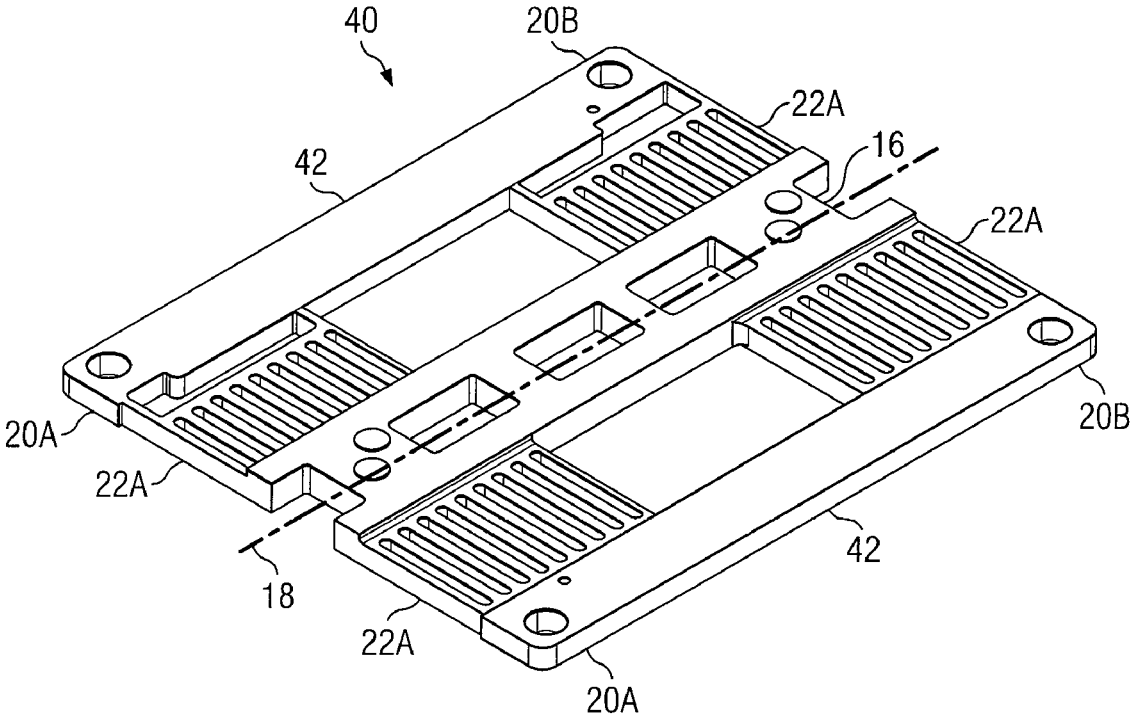
FIG. 4 is a perspective view of an alternative embodiment of a gun sight mounting device according to the teachings of the present disclosure.

FIG. 4 is an alternative embodiment according to the teachings of the present disclosure in which gun sight mounting device 40 may include stiffening bars 42. The gun mount portion 16, sight mount portion 20, and resilient member 22 are similar in design and purpose to the gun mount portion 16, sight mount portion 20, and resilient member 22 of gun sight mounting device 10. Gun sight mounting device 40 differs from the embodiment of FIGS. 2A through 2C, however, in that a pair of stiffening bars 42 are included that are each coupled to one of the two front attachment members 20*a* and one of the two rear attachment members 20*b*. Each of the pair of stiffening bars 42 extend in a direction that is generally parallel to the gun sight mounting portion axis 18. Certain embodiments incorporating stiffening bars 42 may provide an advantage in that flexibility along axes not parallel to the gun sight mounting portion axis 18 may be reduced for enhanced alignment of the gun sight 12 with the gun 14 during recoil action caused by use of the gun 14. That is, the stiffening bars 42 may provide enhanced structural rigidity for sight attachment members 20*a* and 20*b* against vibrational forces that may be imparted onto the gun sight mounting device 10 along the gun sight mounting portion axis 18 in certain embodiments.

Several embodiments of a gun sight mounting device 10 have been described that may reduce vibrational energy transferred from the recoil action of a gun 14 to a gun sight 12. This reduction in vibrational energy may be tailored by selecting the spring constant of the resilient member 22 to be different from the natural resonant frequency of one or more components in the gun sight 12. In this manner certain components of the gun sight 12 may be protected from damage from undue vibrational energy generated by a recoil action of the gun 14. Thus, use of the gun sight mounting device 10 that may enable use of certain gun sights 12 that may be potentially damaged by direct coupling to the gun 14

Although the present disclosure and its advantages have been described in detail, it should be understood that various changes, substitutions, and alterations can be made therein without departing from the spirit and scope of the disclosure as defined by the appended claims.

What is claimed is:

1. A firearm system comprising:

a gun having a longitudinal axis;

a gun sight for enhancing the aim of the gun; and a gun sight mounting device comprising:

a gun mount portion that is attached to the gun;

a sight mount portion that is attached to the gun sight, the sight mount portion comprising two front sight mount portions and two rear sight mount portions arranged in a rectilinear spaced apart relation to one another; and a plurality of leaf springs coupling the gun mount portion to the sight mount portion, the plurality of leaf springs being flexible only along a first of three axes, wherein the three axes are generally perpendicular to one another and the first axis is parallel to the longitudinal axis of the gun.

2. The apparatus of claim 1, wherein the gun mount portion, the two front sight mount portions, the two rear sight mount portion, and the plurality of leaf springs are integrally formed from one piece of aluminum.

3. The apparatus of claim 1, further comprising a pair of stiffening bars that are each coupled to one of the two front sight mount portions and one of the two rear sight mount portions such that the axis of each of the pair of stiffening bars are generally parallel to the longitudinal axis of the gun when the gun mount portion is coupled to the gun.

4. The apparatus of claim 1, wherein the gun mount portion is a picatinny rail having dimensions that are specified according to a military standard specification (MIL-STD-1913).

5. A system comprising:

a gun having a longitudinal axis;

a gun sight for enhancing the aim of the gun; and a gun sight mounting device comprising:

a gun mount portion that is attached to the gun;

a sight mount portion that is attached to the gun sight; and a resilient member coupling the gun mount portion to the sight mount portion, the resilient member being flexible only along a first of three axes, wherein the three axes are generally perpendicular to one another and the first axis is parallel to the longitudinal axis of the gun.

6. The apparatus of claim 5, wherein the resilient member is generally inflexible along a second axis that is generally perpendicular to the longitudinal axis of the gun.

7. The apparatus of claim 5, wherein the resilient member is essentially flexible only along the first axis.

8. The apparatus of claim 5, wherein the resilient member has a spring constant such that a first resonant frequency of the sight mount portion and the gun sight is different from a second resonant frequency of at least one component of the gun sight.

9. The apparatus of claim 5, wherein the resilient member comprises a plurality of leaf springs.

10. The apparatus of claim 9, wherein the sight mount portion comprises a plurality of attachment portions for attachment of the gun sight to the sight mount portion, each of the plurality of attachment portions disposed proximate to at least one of the plurality of leaf springs.

11. The apparatus of claim 5, wherein the sight mount portion comprises four attachment portions arranged in a rectilinear spaced apart relation to one another, and a pair of stiffening bars that are each coupled between two of the four attachment portions such that the axis of each of the pair of stiffening bars are generally parallel to the longitudinal axis of the gun.

12. The apparatus of claim 5, wherein the sight mount portion comprises two front attachment portions and two rear attachment portions arranged in a rectilinear spaced apart relation to one another, and a pair of stiffening bars that are each coupled to one of the two front attachment portions and one of the two rear attachment portions such that the axis of each of the pair of stiffening bars are generally perpendicular to the longitudinal axis of the gun when the gun mount portion is coupled to the gun.

13. The apparatus of claim 5, wherein the gun mount portion is a picatinny rail having dimensions that are specified according to a military standard specification (MIL-STD-1913).

14. An apparatus comprising:

a gun mount portion for attachment to a gun;

a sight mount portion for attachment to a gun sight, wherein the sight mount portion comprises four attachment portions arranged in a rectilinear spaced apart relation to one another, and a pair of stiffening bars that are each coupled between two of the four attachment portions such that the axis of each of the pair of stiffening bars are generally parallel to the longitudinal axis of the gun; and a resilient member coupling the gun mount portion to the sight mount portion, the resilient member configured to allow, when attached to the gun, a linear displacement of the sight mount portion relative to the gun mount portion only along a longitudinal axis of the gun.

15. The apparatus of claim 14, wherein the resilient member is further operable to inhibit linear displacement of the sight mount portion relative to the gun mount portion that is generally perpendicular to the longitudinal axis of the gun.

16. The apparatus of claim 14, wherein the resilient member is further operable to allow a linear displacement of the sight mount portion relative to the gun mount portion that is essentially parallel only to the longitudinal axis of the gun.

17. The apparatus of claim 14, wherein the resilient member has a spring constant such that a first resonant frequency of the sight mount portion and the gun sight is different from a second resonant frequency of at least one component of the gun sight.

18. The apparatus of claim 14, wherein the resilient member comprises a plurality of leaf springs.

19. The apparatus of claim 18, wherein the sight mount portion comprises a plurality of attachment portions for attachment of the gun sight to the sight mount portion, each of the plurality of attachment portions disposed proximate to at least one of the plurality of leaf springs.

20. The apparatus of claim 14, wherein the gun mount portion is a picatinny rail having dimensions that are specified according to a military standard specification (MIL-STD-1913).

21. An apparatus comprising:

a gun mount portion for attachment to a gun;

a sight mount portion for attachment to a gun sight, wherein the sight mount portion comprises two front attachment portions and two rear attachment portions arranged in a rectilinear spaced apart relation to one another, and a pair of stiffening bars that are each coupled to one of the two front attachment portions and one of the two rear attachment portions such that the axis of each of the pair of stiffening bars are generally perpendicular to the longitudinal axis of the gun when the gun mount portion is coupled to the gun; and a resilient member coupling the gun mount portion to the sight mount portion, the resilient member configured to allow, when attached to the gun, a linear displacement of the sight mount portion relative to the gun mount portion only along a longitudinal axis of the gun.

22. A system comprising:

a gun having a longitudinal axis;

a gun sight for enhancing the aim of the gun; and a gun sight mounting device comprising:

a gun mount portion that is attached to the gun;

a sight mount portion that is attached to the gun sight, wherein the sight mount portion comprises four attachment portions arranged in a rectilinear spaced apart relation to one another, and a pair of stiffening bars that are each coupled between two of the four attachment portions such that the axis of each of the pair of stiffening bars are generally parallel to the longitudinal axis of the gun; and a resilient member coupling the gun mount portion to the sight mount portion, the resilient member being flexible along a first axis that is parallel to the longitudinal axis of the gun.

23. An apparatus comprising:

a gun mount portion for attachment to a gun;

a sight mount portion for attachment to a gun sight, wherein the sight mount portion comprises four attachment portions arranged in a rectilinear spaced apart relation to one another, and a pair of stiffening bars that are each coupled between two of the four attachment portions such that the axis of each of the pair of stiffening bars are generally parallel to the longitudinal axis of the gun; and a resilient member coupling the gun mount portion to the sight mount portion, the resilient member configured to allow, when attached to the gun, a linear displacement of the sight mount portion relative to the gun mount portion along a longitudinal axis of the gun.

* * * * *